US008926478B2

(12) United States Patent
Huang et al.

(10) Patent No.: US 8,926,478 B2
(45) Date of Patent: Jan. 6, 2015

(54) ELLIPTICAL TRAINER

(71) Applicant: Dyaco International Inc., Taipei (TW)

(72) Inventors: Hsuan-Fu Huang, Changua County (TW); Shih-Wei Liu, Changua County (TW)

(73) Assignee: Dyaco International Inc., Taipei (TW)

( * ) Notice: Subject to any disclaimer, the term of this patent is extended or adjusted under 35 U.S.C. 154(b) by 133 days.

(21) Appl. No.: 13/804,305

(22) Filed: Mar. 14, 2013

(65) Prior Publication Data

US 2014/0221166 A1 Aug. 7, 2014

(30) Foreign Application Priority Data

Feb. 4, 2013 (TW) ..... 102104273 U

(51) Int. Cl.
*A63B 21/00* (2006.01)
*A63B 22/04* (2006.01)

(52) U.S. Cl.
CPC ..... *A63B 22/04* (2013.01)
USPC ..... 482/52; 482/51; 482/61; 482/57

(58) Field of Classification Search
USPC ..... 482/57, 52, 51, 70, 74, 64, 63, 61
See application file for complete search history.

(56) References Cited

U.S. PATENT DOCUMENTS

| | | | | |
|---|---|---|---|---|
| 5,573,480 | A | 11/1996 | Rodgers, Jr. | |
| 7,682,290 | B2 | 3/2010 | Liao et al. | |
| 2004/0235621 | A1 * | 11/2004 | Eschenbach | 482/52 |
| 2009/0093346 | A1 * | 4/2009 | Nelson et al. | 482/52 |
| 2010/0190613 | A1 * | 7/2010 | Murray et al. | 482/52 |
| 2011/0039661 | A1 * | 2/2011 | Long | 482/52 |
| 2011/0172062 | A1 * | 7/2011 | Miller | 482/52 |

FOREIGN PATENT DOCUMENTS

| | | |
|---|---|---|
| TW | M252461 | 12/2000 |

* cited by examiner

*Primary Examiner* — Jerome w Donnelly
(74) *Attorney, Agent, or Firm* — Huffman Law Group, PC

(57) ABSTRACT

An elliptical trainer includes a base, a pair of foot-oriented elliptical mechanisms, and a pair of hand-oriented elliptical mechanisms. The base is anteriorly provided with a frame having a first axle and a second axle. The first and second axles are parallel and spaced apart by a distance. The foot-oriented elliptical mechanisms flank the frame and include a revolving assembly pivotally disposed at the first axle and adapted to enable the foot-oriented elliptical mechanisms to revolve relative to the first axle. The hand-oriented elliptical mechanisms flank the frame and include a reversing assembly pivotally disposed at the second axle. The revolving assembly and the reversing assembly revolve in opposite directions. The hand-oriented and foot-oriented elliptical mechanisms enable a user's hands and feet to revolve in the same direction and follow closed paths, respectively. Hence, the user can exercise ergonomically and work different muscle groups.

9 Claims, 9 Drawing Sheets

ELLIPTICAL TRAINER

BACKGROUND OF THE INVENTION

1. Field of the Invention

The present invention relates to workout devices, and more particularly, to a workout device characterized in that the user's hands and feet revolve in the same direction while exercising with the workout device.

2. Description of Related Art

Due to technological advancements and economic prosperity, people's living standards improve continuously, so does the demand for leisure and recreation, such as fitness workouts, travel, and shopping. Workouts are carried out either indoors or outdoors. Common indoor workout devices abound and include elliptical trainers, treadmills, flywheel bicycles, large weight training devices, and workout benches. The elliptical trainer guides a user's feet to follow a substantially elliptical unending path in order to take cyclic exercise. Exercising in this way not only approximates to walking or running as far as the lower limbs are concerned, but also has less impact on the user's knee joint and ankle joints. Hence, elliptical trainers are popular with consumers and thus manifest continuous market growth in recent years.

U.S. Pat. No. 5,573,480 discloses an elliptical trainer that enables a user's feet to move along a substantially elliptical path, because a supporting rod has one end for performing a circular-path motion in conjunction with a crank mechanism and has the other end whose motion is restricted to sliding along a linear path and reciprocating; hence, a specific portion of the supporting rod follows a substantially elliptical path. U.S. Pat. No. 7,682,290 disposes that one end of a supporting rod for use with a user's foot is pivotally connected to an external end of a crank to thereby restrict the supporting rod to a circular path, and discloses that the other end of the supporting rod is pivotally connected to a bottom end of a swing arm and restricted to a curved path for swinging back and forth. However, the aforesaid patents focus on foot-specific elliptical path movement, but make the user's hand hold on to a handlebar for swinging back and forth monotonously. In view of this, Taiwan patent M252461 discloses: an elliptical trainer for simulating upper-limb movement, characterized in that: a primary frame having one end connected to two handlebars; the handlebars each having a bottom portion pivotally connected to a front end of a pedal, wherein the end of the pedal is pivotally connected to a rotational body (such as a flywheel) peripherally; two other pedals positioned oppositely and relative to the rotational body and each performing alternate cyclic movement along a virtual elliptical path, thereby allowing the handlebars to perform elliptical cyclic movement in synchrony with the pedals. However, the aforesaid elliptical trainer simulating upper-limb movement features a substantially circular path along which each of the hands swings, and in consequence the swing of the hands is not based on ergonomics.

SUMMARY OF THE INVENTION

It is an objective of the present invention to provide an elliptical trainer characterized in that the user's hands and feet perform elliptical path movement in the same direction efficiently and ergonomically while exercising with the elliptical trainer in order to work different muscle groups.

In order to achieve the above and other objectives, the present invention provides an elliptical trainer comprising a base, a pair of foot-oriented elliptical mechanisms, and a pair of hand-oriented elliptical mechanisms. The base is anteriorly provided with a frame. The frame has a first axle and a second axle. The first and second axles are parallel and spaced apart from each other by a distance. The foot-oriented elliptical mechanisms are hung on the left and the right of the frame, respectively, and each comprise a revolving assembly. The revolving assembly is rotatably disposed at the first axle and adapted to enable the foot-oriented elliptical mechanisms to revolve relative to the first axle. The hand-oriented elliptical mechanisms are disposed on the left and the right of the frame, respectively, and each comprise a reversing assembly. The reversing assembly is rotatably disposed at the second axle and adapted to revolve in a direction opposite to the revolving assembly.

Hence, an elliptical trainer of the present invention is characterized in that a revolving assembly and a reversing assembly operate together in a manner that hand-oriented elliptical mechanisms enable a user's hands to move along a forward closed movement path as soon as foot-oriented elliptical mechanisms enable the user's feet to move along a forward closed movement path, such that the user can perform an elliptical path movement ergonomically and work different muscle groups.

Objectives, features, and advantages of the present invention are hereunder illustrated with specific embodiments in conjunction with the accompanying drawings, so as to enable persons skilled in the art to understand the disclosure of the present invention and implement the present invention accordingly, and are not intended to be restrictive of the scope of the present invention. Hence, all equivalent modifications, replacements, and omissions made to the specific embodiments of the present invention without departing from the spirit embodied in the disclosure of the present invention should fall within the scope of the present invention as set forth in the appended claims.

BRIEF DESCRIPTION OF THE SEVERAL VIEWS OF THE DRAWINGS

Objectives, features, and advantages of the present invention are hereunder illustrated with specific embodiments in conjunction with the accompanying drawings, in which.

DETAILED DESCRIPTION OF THE EMBODIMENTS OF THE INVENTION

Objectives, features, and advantages of the present invention are hereunder illustrated with specific embodiments.

Figure 1:
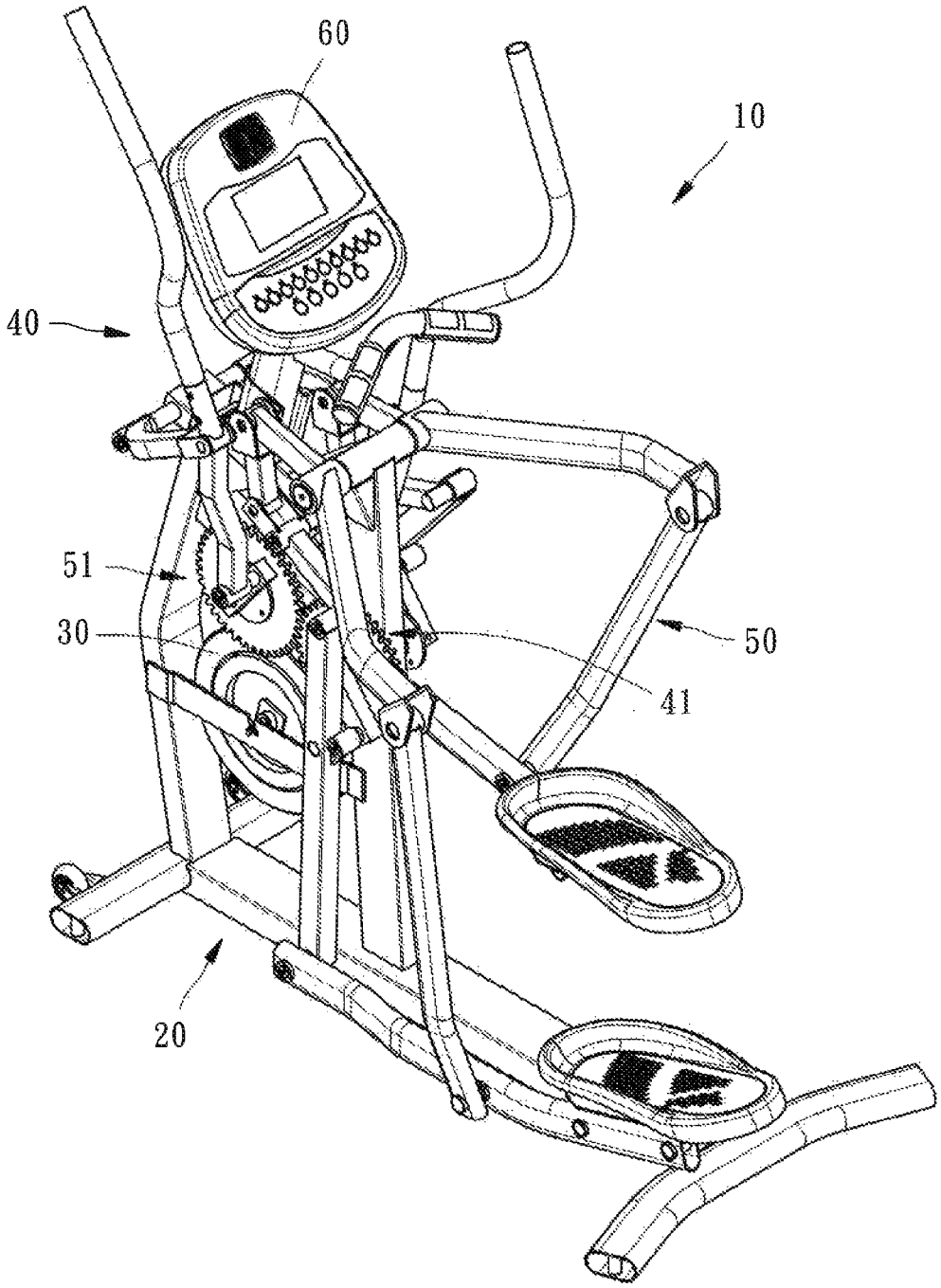
FIG. 1 is a left rear perspective view of an elliptical trainer according to a preferred embodiment of the present invention.
Figure 2:
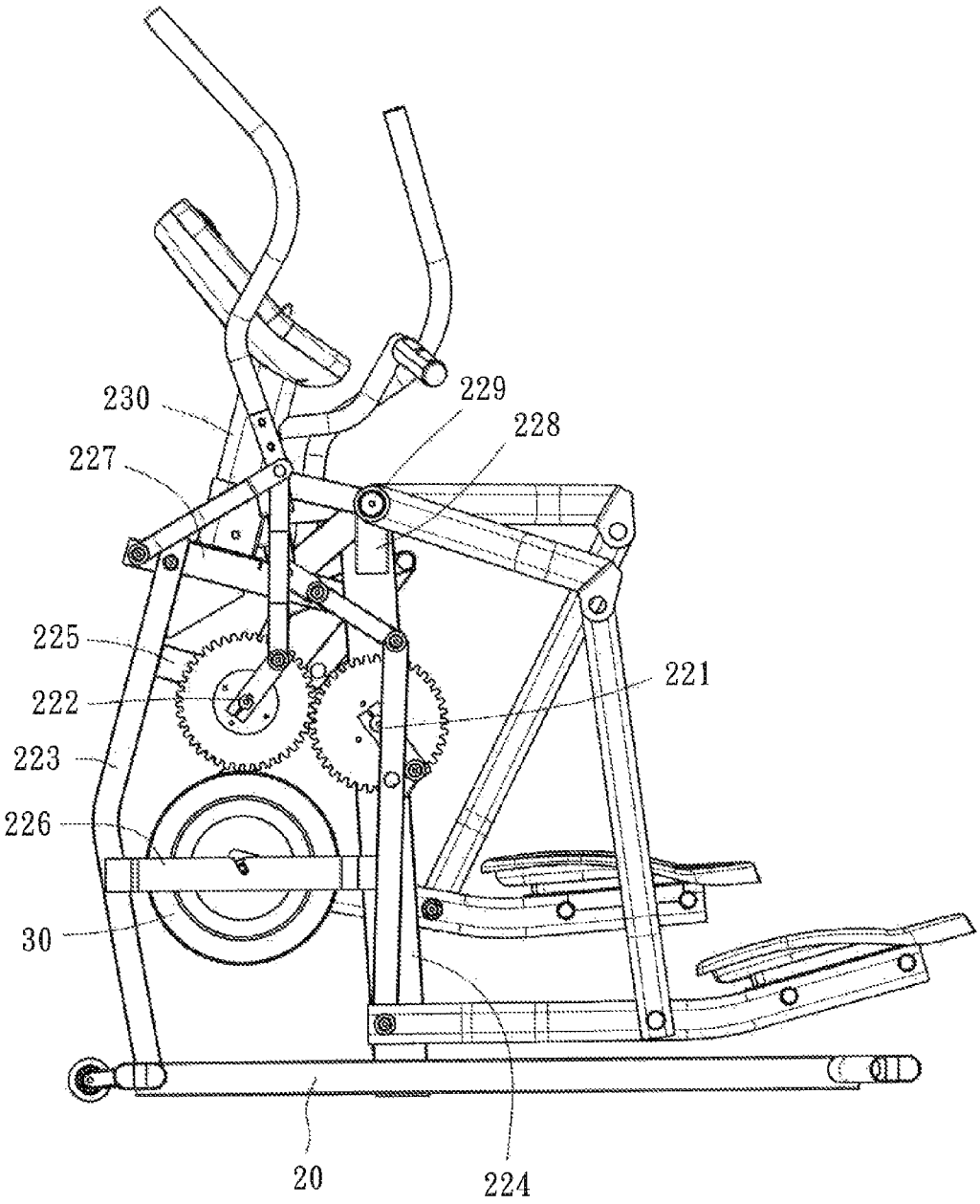
FIG. 2 is a left lateral view of the elliptical trainer according to the preferred embodiment of the present invention.
Figure 3:
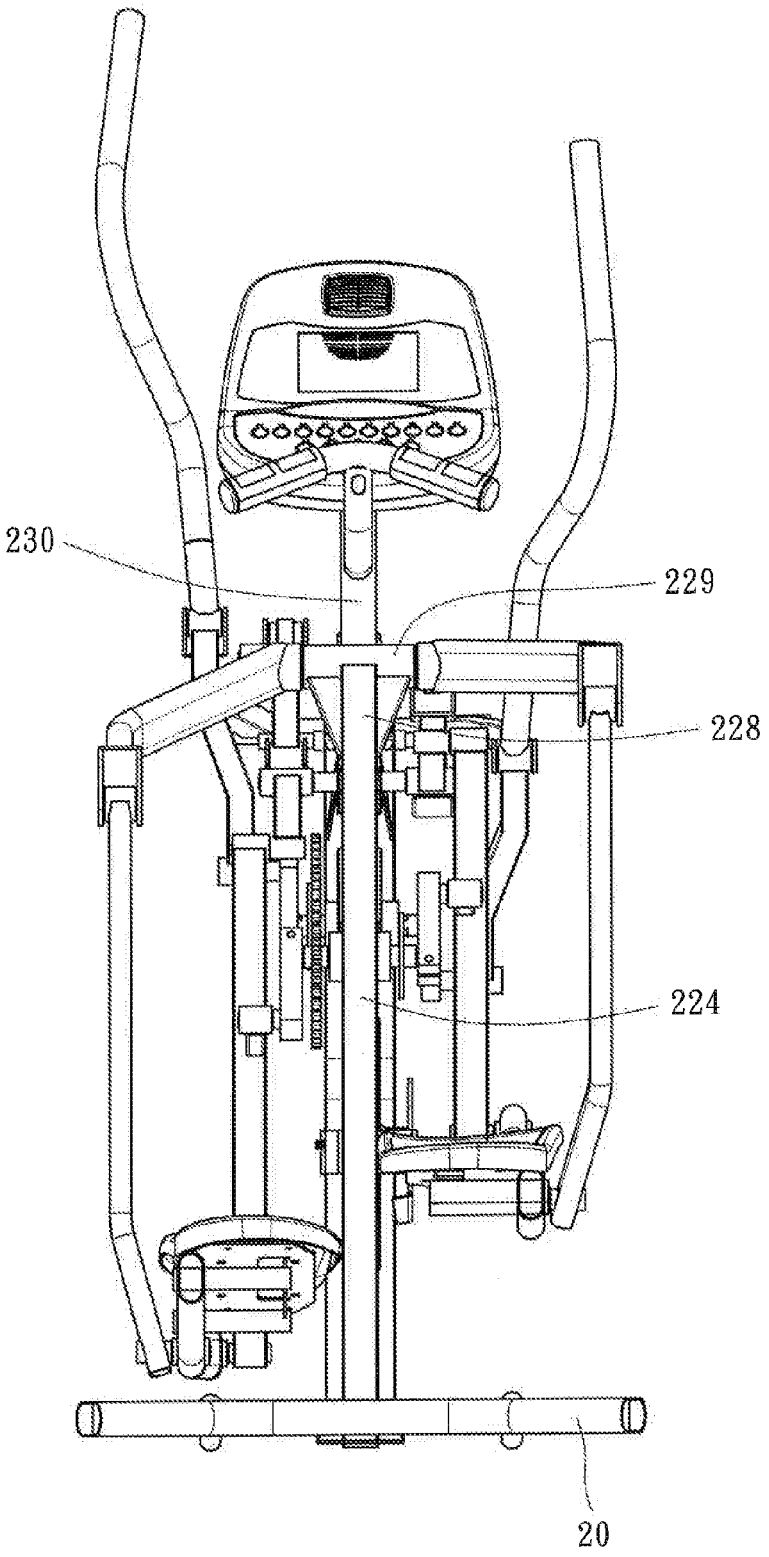
FIG. 3 is a rear view of the elliptical trainer according to the preferred embodiment of the present invention.
Figure 4:
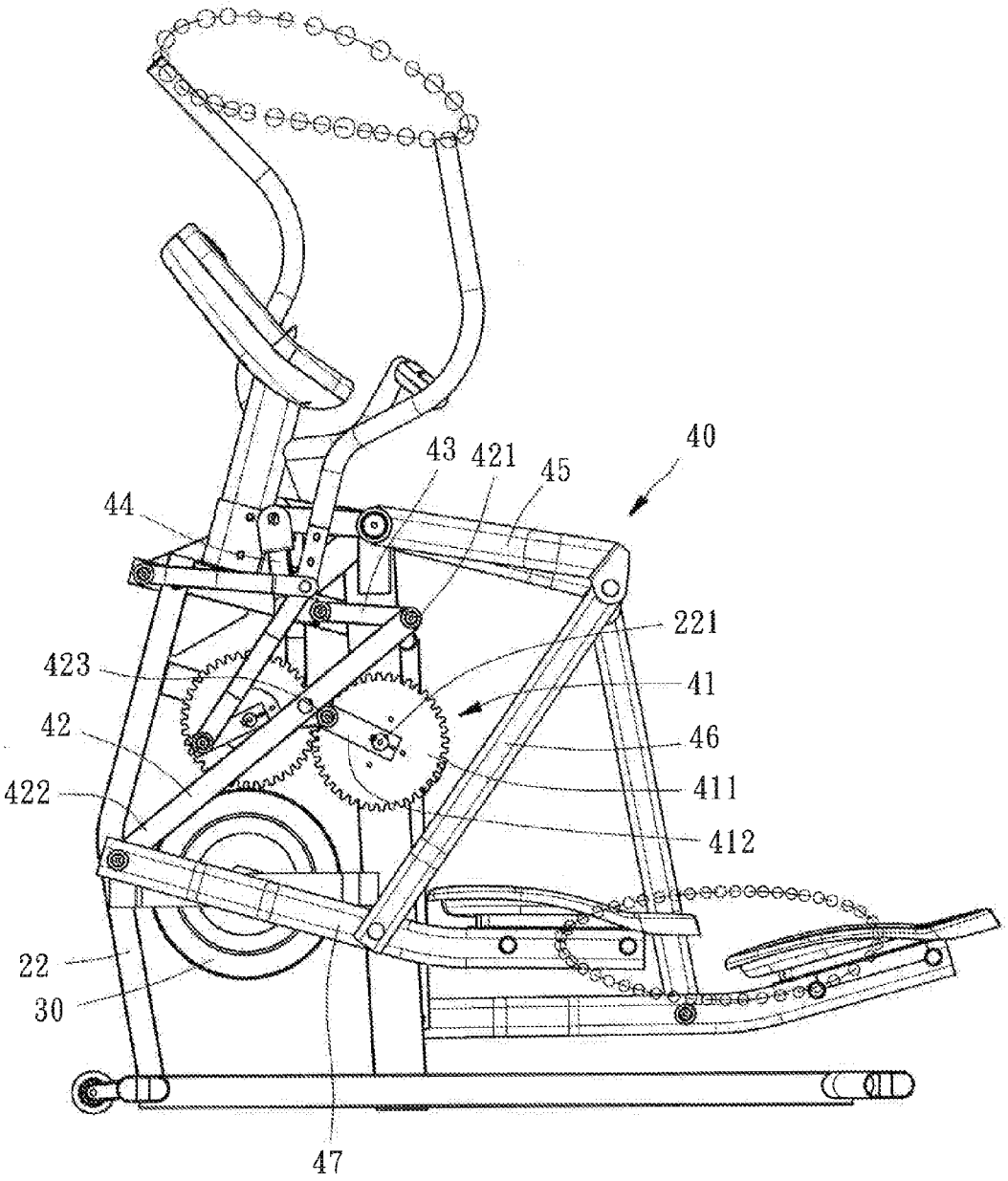
FIG. 4 is a left lateral view of the elliptical trainer according to the preferred embodiment of the present invention, illustrating a foot-oriented elliptical path and a hand-oriented elliptical path.
Figure 5:
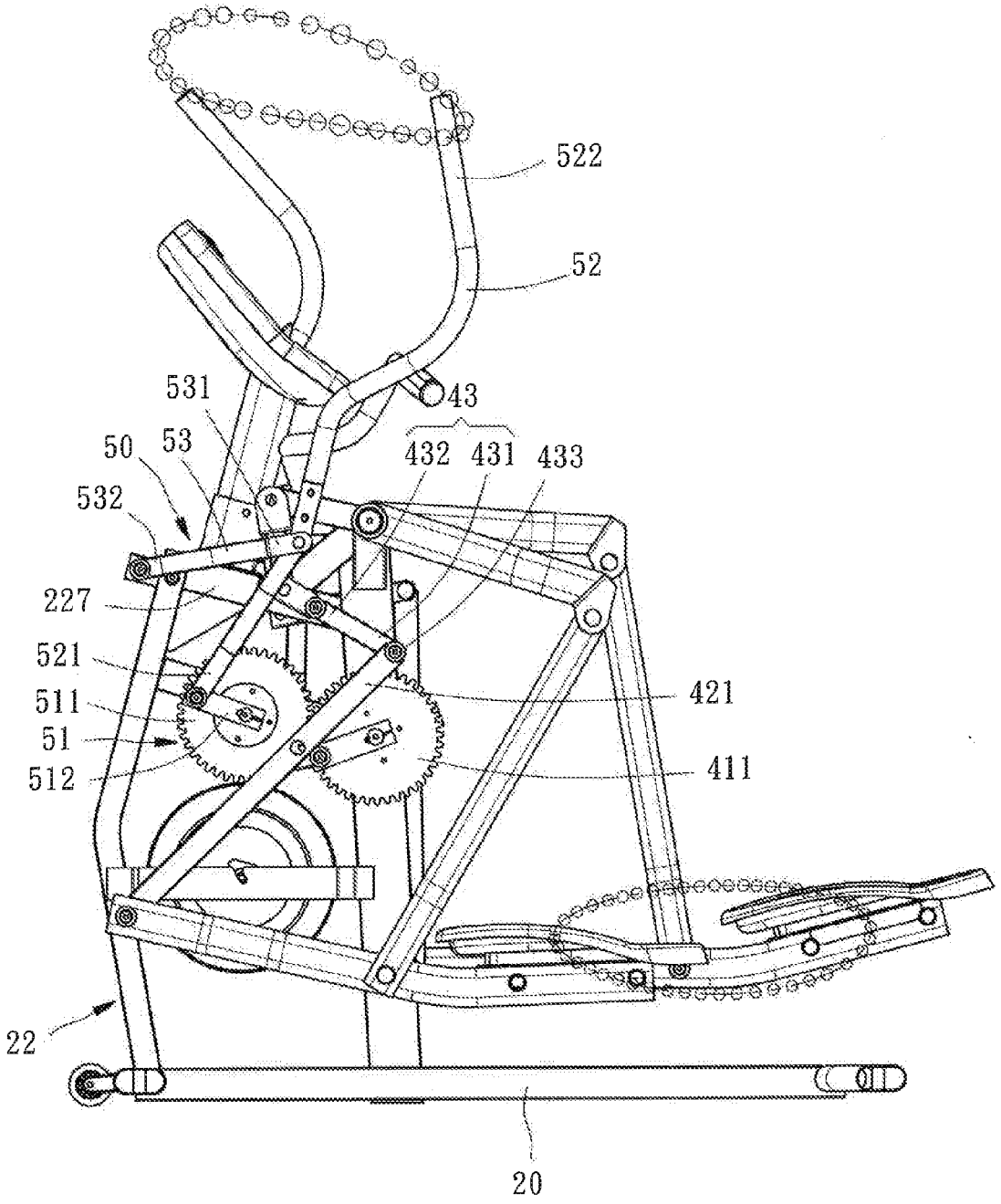
FIG. 5 through FIG. 9 are similar to FIG. 4 but illustrate the feet and the hands at different points along the elliptical paths, respectively.
Figure 6:
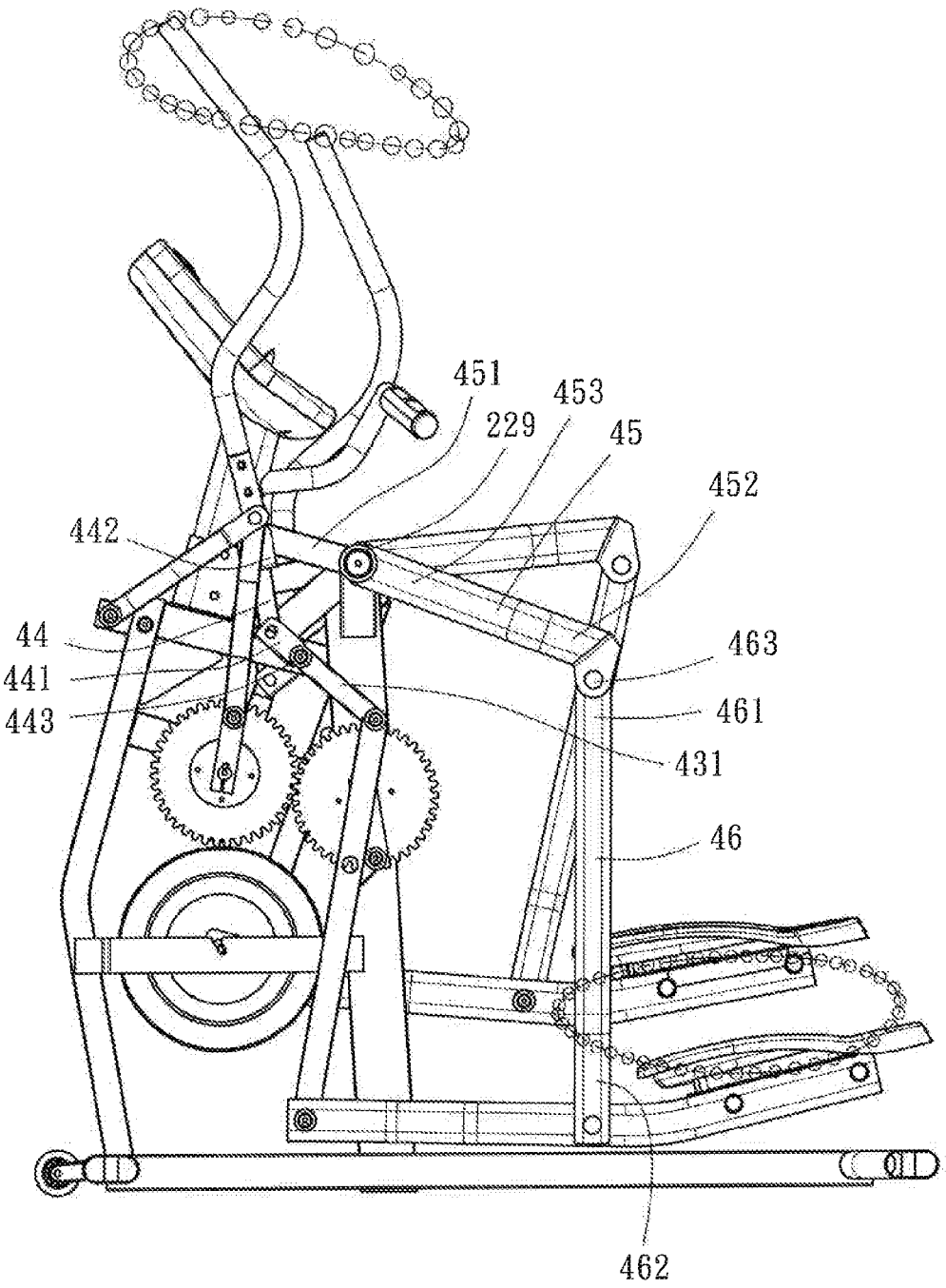
Figure 7:
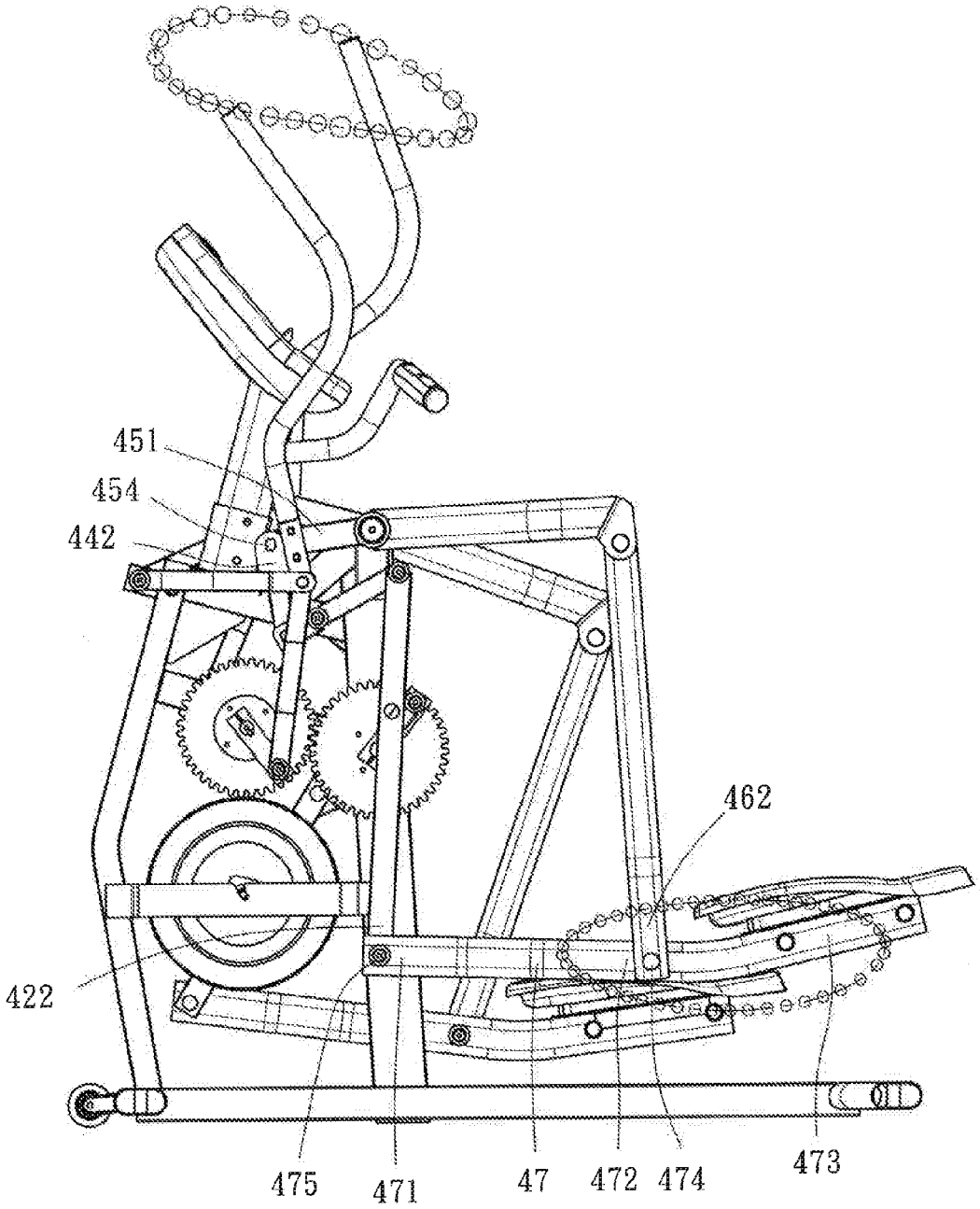
Figure 8:
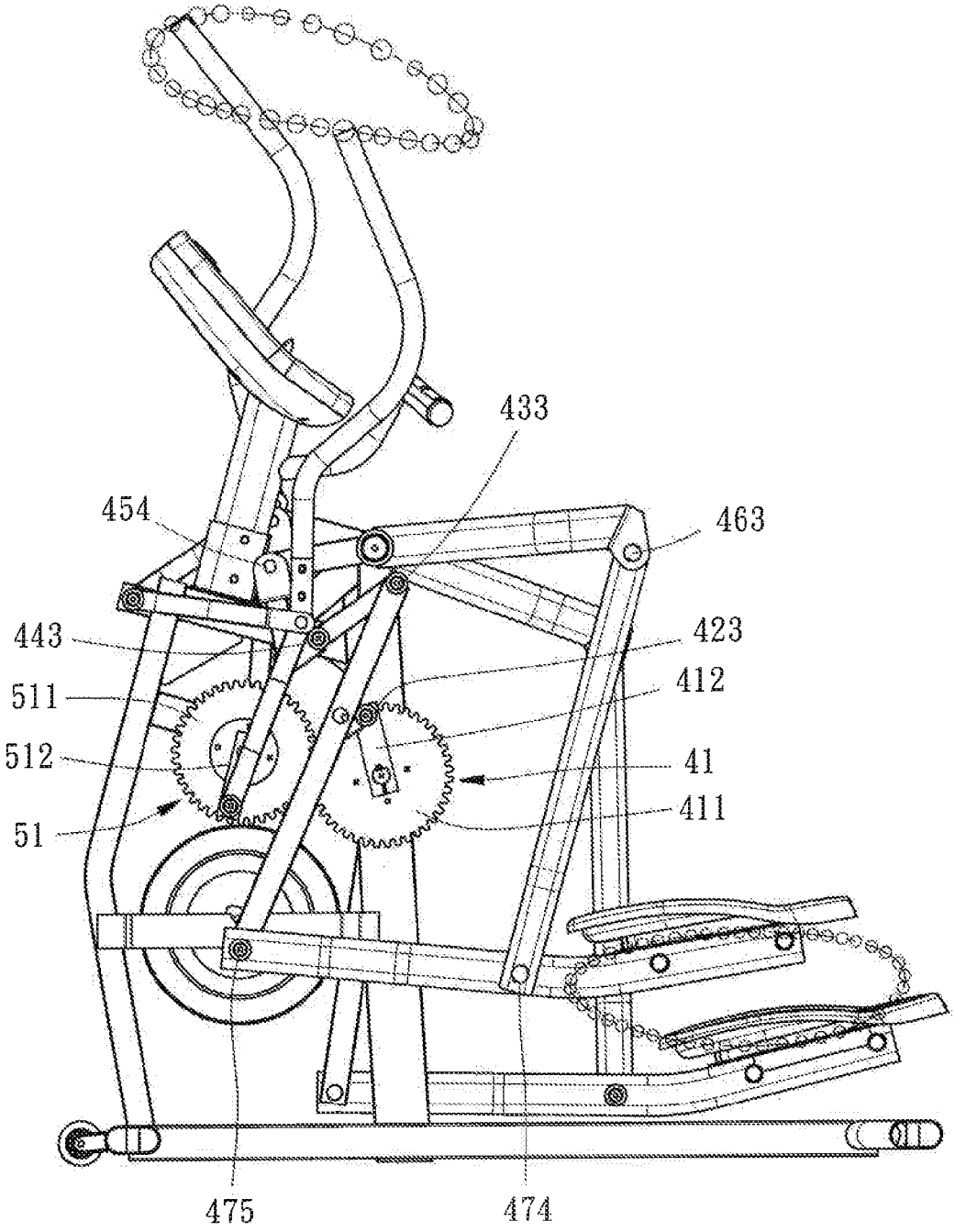
Figure 9:
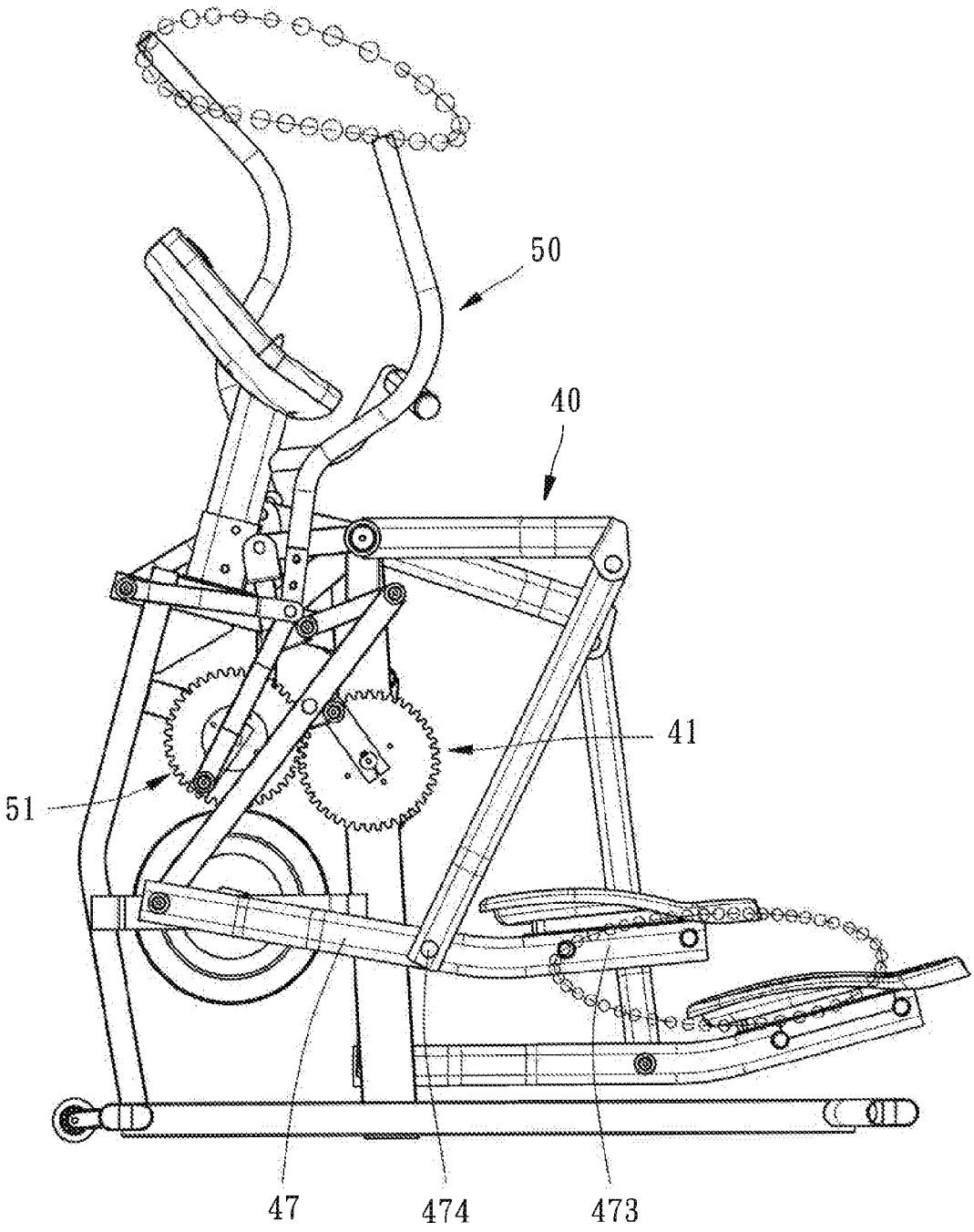

FIG. 1 is a left rear perspective view of an elliptical trainer according to a preferred embodiment of the present invention;

FIG. 2 is a left lateral view of the elliptical trainer according to the preferred embodiment of the present invention;

FIG. 3 is a rear view of the elliptical trainer according to the preferred embodiment of the present invention;

FIG. 4 is a left lateral view of the elliptical trainer according to the preferred embodiment of the present invention, illustrating a foot-oriented elliptical path and a hand-oriented elliptical path; and FIG. 5 through FIG. 9 are similar to FIG. 4 but illustrate the feet and the hands at different points along the elliptical paths, respectively.

Referring to FIG. 1 through FIG. 3, there are shown diagrams of an elliptical trainer 10 according to a preferred embodiment of the present invention. The elliptical trainer 10 comprises a base 20, a flywheel 30, a pair of foot-oriented elliptical mechanisms 40, a pair of hand-oriented elliptical mechanisms 50, and a control panel 60.

The base 20 is anteriorly provided with a frame 22. The frame 22 has a first axle 221 and a second axle 222. The first and second axles 221, 222 are parallel and spaced apart from each other by a distance. The frame 22 comprises a first vertical section 223, a second vertical section 224, a first horizontal section 225, a second horizontal section 226, and a third horizontal section 227. The first vertical section 223 is disposed in front of the second vertical section 224. The third horizontal section 227 is disposed above the first horizontal section 225. The first horizontal section 225 is disposed above the second horizontal section 226. The first, second, and third horizontal sections 225, 226, 227 are disposed between the vertical sections 223, 224. The second vertical section 224 extends in the direction of the third horizontal section 227 to form an extending section 228. A transverse rod 229 is disposed between the top ends of the extending section 228. A fixing rod 230 that protrudes is disposed above the third horizontal section 227. The control panel 60 is disposed at the top end of the fixing rod 230.

The flywheel 30 is rotatably and pivotally disposed at the second horizontal section 226. One lateral side of the flywheel 30 is coaxially fixed to a first belt pulley (not shown).

The foot-oriented elliptical mechanisms 40 are hung on the left and the right of the frame 22, respectively. The foot-oriented elliptical mechanisms 40 each comprise a revolving assembly 41, a transmission rod 42, a first link rod 43, a driving rod 44, a second link rod 45, a swing arm 46, and a supporting rod 47. The revolving assembly 41 is rotatably disposed at the first axle 221 and adapted to allow the foot-oriented elliptical mechanisms 40 to revolve relative to the first axle 221. The revolving assembly 41 has a first gear 411 and a pair of first cranks 412 rotatable together with the first gear 411 coaxially and synchronously. The first gear 411 has a coaxial second belt pulley (not shown). A transmission belt (not shown) is disposed around and between the first belt pulley and the second belt pulley and adapted to enable the first and second belt pulleys to rotate relative to each other. The flywheel 30 enables the revolving assembly 41 to revolve under inertia. The first cranks 412 are disposed on the left and the right of the frame 22, respectively. The first cranks 412 are positioned opposite to each other, The transmission rod 42 has a first transmission portion 421 and a second transmission portion 422. Between the first and second transmission portions 421, 422 is pivotally connected the first cranks 412 and forms a first pivotal point 423 to enable the first cranks 412 to revolve relative to the base 20 by performing upward, downward, forward, and backward displacement. The first link rod 43 has a first end portion 431 and a second end portion 432. The first end portion 431 is pivotally connected to the first transmission portion 421 and forms a second pivotal point 433. The driving rod 44 has a first driving portion 441 and a second driving portion 442. The first driving portion 441 is pivotally connected to the second end portion 431 and forms a third pivotal point 443. The second link rod 45 has a first pivotally rotating portion 451, a second pivotally rotating portion 452, and a transit portion 453. The first pivotally rotating portion 451 is pivotally connected to the second driving portion 442 and forms a fourth pivotal point 454. The transit portion 453 is pivotally connected to the transverse rod 229 of the extending section 228 of the base 20, such that the second link rod 45 functions as a lever. The swing arm 46 has a pivotally connecting portion 461 and a swinging portion 462. The pivotally connecting portion 461 is pivotally connected to the second pivotally rotating portion 452 and forms a fifth pivotal point 463. The supporting rod 47 has a first connection portion 471, a second connection portion 472, and a supporting portion 473. The second connection portion 472 is pivotally connected to the swinging portion 462 and forms a sixth pivotal point 474. The first connection portion 471 is pivotally connected to the second transmission portion 422 and forms a seventh pivotal point 475. The supporting portion 473 supports a user's foot. In a preferred embodiment of the present invention, the swing arms 46 are disposed behind the transmission rods 42. The supporting portions 473 extend forward and backward. The first connection portion 471 is positioned in the front. The supporting portion 473 is positioned at the rear. The second connection portion 472 is positioned between the first connection portion 471 and the supporting portion 473.

The hand-oriented elliptical mechanisms 50 are disposed on the left and the right of the frame 22, respectively. The hand-oriented elliptical mechanisms 50 each comprise a reversing assembly 51, a handlebar 52, and a connection rod 53. The reversing assembly 51 is rotatably disposed at the second axle 222. The revolving assembly 41 and the reversing assembly 51 revolve in opposite directions. The reversing assembly 51 has a second gear 511 and a pair of second cranks 512 being coaxial with the second gear 511. The first gear 411 meshes with the second gear 511. The second cranks 512 are positioned on the left and the right of the frame 22, respectively. The second cranks 512 are positioned opposite to each other. The handlebar 52 has a bottom end portion 521 and atop end portion 522. The bottom end portion 521 is pivotally connected to the second cranks 512. The top end portion 522 is adapted to be held in the user's hand to perform a closed elliptical path movement. The connection rod 53 has a rear end portion 531 and a front end portion 532. The rear end portion 531 is pivotally between the top end portion 522 and the bottom end portion 521 of the handlebar 52. The front end portion 532 is pivotally connected to third horizontal section 227 of the base 20.

Referring to FIG. 4 through FIG. 9, the first cranks 412 of the revolving assembly 41 revolve and drive the first gear 411 and the second belt pulley, such that the second belt pulley transmits by a belt a torque to the first belt pulley of the flywheel 30 to thereby drive rotation thereof under inertia. The first gear 411 meshes with a second gear 511 of the reversing assembly 51. Hence, as soon as the first gear 411 rotates in a forward direction, the second gear 511 rotates in a reverse direction, such that the foot-oriented elliptical mechanisms 40 and the hand-oriented elliptical mechanisms 50 enable the user's hands and feet to revolve in the same direction and follow closed paths, respectively. The displacement of the transmission rod 42, the driving rod 44, and the first and second link rods 43, 45 interacts with the swing of the swing arm 46 and the supporting rod 47; hence, as soon as the first cranks 412 revolve forward by an angle, the supporting portion 473 of the supporting rod 47 lies at a corresponding position on the elliptical path. Conversely, as soon as the first cranks 412 revolve reversely, the supporting portion 473 of the supporting rod 47 lies at an opposite position on the elliptical path. The first pivotal point 433 exhibits revolutionary closed path movement. The second, third, and fifth pivotal points 433, 443, 463 exhibit closed path movement by performing upward and downward displacement. The fourth pivotal point 454 exhibits closed path movement tilted at an angle. The seventh pivotal point 475 exhibits closed path movement by performing forward and backward displacement. The sixth pivotal point 474 exhibits path movement by performing upward, downward, forward, and backward curved displacement. Hence, the supporting portion 473 of the supporting rod 47 moves along a closed elliptical path with segmental junctions spaced apart by a relatively short distance.

In conclusion, an elliptical trainer of the present invention is characterized in that the revolving assembly 41 and the reversing assembly 51 operate together in a manner that the hand-oriented elliptical mechanisms 50 enable the user's hands to move along a forward closed movement path as soon as the foot-oriented elliptical mechanisms 40 enable the user's feet to move along a forward closed movement path, such that a user can perform an elliptical path movement ergonomically, work different muscle groups, and be protected against muscle strains and joint sprains which might otherwise be caused by had movement or poor posture.

The components disclosed in the above embodiments of the present invention are illustrative rather than restrictive of the present invention. Therefore, their replacement with other equivalent components and changes made to the above embodiments of the present invention shall fall into the scope of the claims of the present invention.

What is claimed is:

1. An elliptical trainer, comprising:

a base anteriorly provided with a frame, the frame having a first axle and a second axle, the first and second axles being parallel and spaced apart by a distance;

a pair of foot-oriented elliptical mechanisms hung on a right and a left of the frame, respectively, and each comprising a revolving assembly rotatably disposed at the first axle and adapted to enable the foot-oriented elliptical mechanisms to revolve relative to the first axle;

a pair of hand-oriented elliptical mechanisms disposed on the right and the left of the frame, respectively, and each comprising a reversing assembly rotatably disposed at the second axle and rotating in a direction opposite to the revolving assembly.

2. The elliptical trainer of claim 1, wherein the revolving assembly has a first gear and a pair of first cranks being coaxial with the first gear, wherein the reversing assembly has a second gear and a pair of second cranks being coaxial with the second gear meshing with the first gear, the first and second cranks being disposed on the left and the right of the frame, respectively, and being positioned opposite to each other.

3. The elliptical trainer of claim 2, wherein the foot-oriented elliptical mechanisms each comprise a transmission rod, a first link rod, a driving rod, a second link rod, a swing arm, and a supporting rod, the transmission rod having a first transmission portion and a second transmission portion, the first cranks pivotally connected between the first and second transmission portions, the first link rod having a first end portion and a second end portion, the first end portion being pivotally connected to the first transmission portion, the driving rod having a first driving portion and a second driving portion, the first driving portion being pivotally connected to the second end portion, the second link rod having a first pivotally rotating portion, a second pivotally rotating portion, and a transit portion, the first pivotally rotating portion being pivotally connected to the second driving portion, the transit portion being pivotally connected to the base, the swing arm having a pivotally connecting portion and a swinging portion, the pivotally connecting portion being pivotally connected to the second pivotally rotating portion, the supporting rod having a first connection portion, a second connection portion, and a supporting portion, the first connection portion being pivotally connected to the second transmission portion, the second connection portion being pivotally connected to the swinging portion, and the supporting portion supporting a user's foot.

4. The elliptical trainer of claim 3, wherein the swing arms are disposed behind the transmission rods, wherein the supporting portions extend forward and backward, wherein the first connection portion is positioned in front, wherein the supporting portion is positioned at rear, wherein the second connection portion is positioned between the first connection portion and the supporting portion.

5. The elliptical trainer of claim 3, wherein the hand-oriented elliptical mechanisms each comprise a handlebar and a connection rod, the handlebar having a bottom end portion and a top end portion, the bottom end portions being pivotally connected to the second cranks, respectively, the top end portions being adapted to be held in the user's hands, respectively, to perform a closed elliptical path movement, the connection rod having a rear end portion and a front end portion, the rear end portion being pivotally connected between the top end portion and the bottom end portion of the handlebar, and the front end portion being pivotally connected to the base.

6. The elliptical trainer of claim 2, wherein the frame of the base comprises a first vertical section, a second vertical section, a first horizontal section, a second horizontal section, and a third horizontal section, the first vertical section being disposed in front of the second vertical section, the third horizontal section being disposed above the first horizontal section, the first horizontal section being disposed above the second horizontal section, and the first, second, and third horizontal sections being disposed between the first and second vertical sections.

7. The elliptical trainer of claim 6, wherein a front end portion of the connection rod is pivotally connected to a third horizontal section of the base.

8. The elliptical trainer of claim 6, further comprising a flywheel pivotally disposed at the second horizontal section and adapted to rotate in synchrony with the revolving assembly.

9. The elliptical trainer of claim 8, wherein the first gear has a belt pulley being coaxial therewith and driving the flywheel by belt-based transmission.

* * * * *